US012433385B2

(12) United States Patent
Wojczak et al.

(10) Patent No.: US 12,433,385 B2
(45) Date of Patent: Oct. 7, 2025

(54) HAIR STRAIGHTENING AND STYLING APPLIANCE

(71) Applicant: CONAIR CORPORATION, Stamford, CT (US)

(72) Inventors: Sophia Wojczak, Harrison, NY (US); Lawrence Cruz, Weston, CT (US)

(73) Assignee: CONAIR LLC, Stamford, CT (US)

( * ) Notice: Subject to any disclaimer, the term of this patent is extended or adjusted under 35 U.S.C. 154(b) by 200 days.

(21) Appl. No.: 16/919,255

(22) Filed: Jul. 2, 2020

(65) Prior Publication Data

US 2022/0000239 A1 Jan. 6, 2022

(51) Int. Cl.

| | |
|---|---|
| ***A45D 1/04*** | (2006.01) |
| ***A45D 2/00*** | (2006.01) |
| *A45D 1/06* | (2006.01) |

(52) U.S. Cl.

CPC ..... *A45D 2/001* (2013.01); *A45D 1/04* (2013.01); *A45D 1/06* (2013.01)

(58) Field of Classification Search

CPC . A45D 1/02; A45D 2/002; A45D 1/18; A45D 1/06; A45D 1/04; A45D 2/001

See application file for complete search history.

(56) References Cited

U.S. PATENT DOCUMENTS

| | | | | |
|---|---|---|---|---|
| 1,105,962 A | | 8/1914 | Carlson | |
| 1,510,359 A | | 9/1924 | Van Gale | |
| 2,598,330 A | * | 5/1952 | Wilson | A45D 20/525 132/117 |
| D253,849 S | * | 1/1980 | Schroeder | D28/24 |
| 4,214,597 A | * | 7/1980 | Glassman | A45D 2/36 132/223 |
| 4,866,248 A | * | 9/1989 | Altamore | A45D 1/04 132/229 |
| 5,046,516 A | * | 9/1991 | Barradas | A45D 1/04 219/222 |
| 5,785,064 A | | 7/1998 | Simpson | |
| 5,810,026 A | * | 9/1998 | Sham | A45D 1/04 132/232 |
| 5,868,146 A | * | 2/1999 | Henninger | A45D 1/04 132/232 |
| 5,957,140 A | | 9/1999 | McGee | |
| 6,070,596 A | | 6/2000 | Altamore | |
| 6,354,305 B1 | * | 3/2002 | Janouch | A45D 7/02 132/207 |
| D489,482 S | | 5/2004 | Cho | |

(Continued)

FOREIGN PATENT DOCUMENTS

DE 202007007961 * 11/2008

*Primary Examiner* — Nicholas D Lucchesi
*Assistant Examiner* — Jennifer Gill
(74) *Attorney, Agent, or Firm* — Grogan, Tuccillo & Vanderleeden LLP

(57) ABSTRACT

A hair straightening and styling appliance includes a first elongated member having a first heating plate and a second elongated member having a second heating plate, the second heating plate facing the first heating plate, the second elongated member being hingedly connected to the first elongated member allowing for the first heating plate and the second heating plate to be opened and closed away from and toward each other, respectively. The hair straightening and styling appliance has a teardrop cross-section when the first heating plate and the second heating plates are closed towards each other.

19 Claims, 9 Drawing Sheets

(56) References Cited

U.S. PATENT DOCUMENTS

| | | | | |
|---|---|---|---|---|
| 7,243,661 | B2 | 7/2007 | Lun et al. | |
| 7,341,064 | B2 | 3/2008 | Habibi | |
| 7,540,289 | B2 | 6/2009 | Habibi | |
| D643,974 | S | 8/2011 | Renault | |
| 8,013,274 | B2 | 9/2011 | Suzuki et al. | |
| 8,267,098 | B2 | 9/2012 | Glucksman | |
| 8,455,796 | B2 | 6/2013 | Leung | |
| 8,919,352 | B2 * | 12/2014 | Cocks | A45D 2/001 132/224 |
| 2004/0187884 | A1 * | 9/2004 | Cook | A45D 1/18 132/234 |
| 2005/0022836 | A1 * | 2/2005 | Tong | A45D 1/16 132/224 |
| 2006/0150996 | A1 * | 7/2006 | Lun | A45D 1/06 132/224 |
| 2008/0283081 | A1 | 11/2008 | Habibi | |
| 2011/0139172 | A1 * | 6/2011 | Silva | A45D 2/001 132/269 |
| 2011/0232673 | A1 * | 9/2011 | Crawford | A45D 1/04 132/232 |
| 2014/0332023 | A1 * | 11/2014 | Kaizuka | A45D 2/002 132/118 |

* cited by examiner

HAIR STRAIGHTENING AND STYLING APPLIANCE

FIELD OF THE INVENTION

The present invention relates generally to hair care appliances and, more particularly, appliances for straightening and styling hair.

BACKGROUND OF THE INVENTION

Hair straightening irons, also referred to as flat irons, typically include two handles, each hinged at one end, and having heated heads extending from each handle. The heads have inner surfaces that face each other and have electrically-heated surfaces or platens, usually formed from metal, for straightening or styling hair. In operation, electric heating elements located beneath each surface are activated to warm the surfaces to a desired temperature. The inner surfaces are then positioned around a strand of hair to be styled, and the hinged handles are closed toward each other, thus bringing the heated inner surfaces toward each other to close around the hair strand. The gripped handles are then slid relative to the strand of hair, so as to run along the strand until the strand exits from between the heads.

While existing straightening irons are generally suitable for what may be regarded as ordinary performance, there is room for improvement with respect to overall functionality and operability. In particular, existing devices typically have rectangular heads having fairly broad side edges that limit the ability of the heads to reach close to a user's scalp or tight spaces, such as parted hair.

In view of the above, there is a need for a hair straightening and styling appliance system that improves upon the devices currently known in the art.

SUMMARY OF THE INVENTION

It is an object of the present invention to provide a hair straightening and styling appliance.

It is another object of the present invention to provide a hair straightening and styling appliance that has the ability to reach close to a user's scalp or tight spaces, such as parted hair.

It is another object of the present invention to provide a hair straightening and styling appliance that separates and straightens strands of hair.

These and other objects are achieved by the present invention.

According to an embodiment of the invention, a hair straightening and styling appliance includes a first elongated member having a first heating plate, and a second elongated member having a second heating plate, the second heating plate facing the first heating plate, the second elongated member being hingedly connected to the first elongated member allowing for the first heating plate and the second heating plate to be opened and closed away from and toward each other, respectively. The hair straightening and styling appliance has a teardrop cross-section when the first heating plate and the second heating plates are closed towards each other.

According to another embodiment of the invention, a hair straightening and styling appliance includes a first elongated member having a first handle portion and a first head portion, and a first heating plate carried by the first head portion, and a second elongated member having a first handle portion and a second head portion, and a second heating plate carried by the second head portion, the second heating plate facing the first heating plate, the second elongated member being pivotally connected to the first elongated member allowing for the first heating plate and the second heating plate to be opened and closed away from and toward each other, respectively. The hair straightening and styling appliance has a teardrop cross-section when the first heating plate and the second heating plates are closed towards each other. The hair straightening and styling appliance further includes at least one of a plurality of pins and/or a plurality of ribs on an exterior surface of the first head portion and/or the second head portion.

According to yet another embodiment of the invention, a hair straightening and styling appliance includes a first elongated member having a first heating plate, and a second elongated member having a second heating plate, the second heating plate facing the first heating plate, the second elongated member being hingedly connected to the first elongated member allowing for the first heating plate and the second heating plate to be opened and closed away from and toward each other, respectively. Each elongated member includes an exterior surface having a convex section and a concave section adjacent to the convex section and terminating in a tapered edge.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
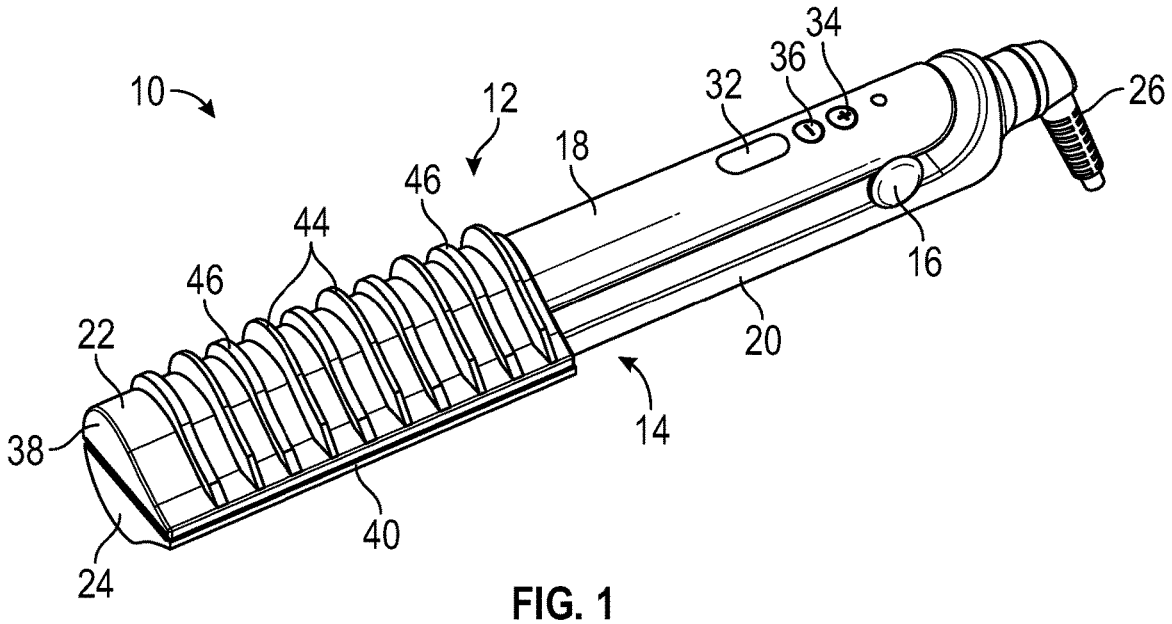
FIG. 1 is a perspective view of a hair straightening and styling appliance according to an embodiment of the present invention, illustrating a closed position.

Referring to FIGS. 1-6, a hair straightening and styling appliance 10 (referred to herein as simply hair straightening appliance 10) according to an embodiment of the present invention is illustrated. As shown therein, the hair straightening appliance includes a first arm or elongated member 12 and a second arm or elongated member 14 hingedly connected to one another at a hinge 16. The first and second elongated members 12, 14 each include respective handle or gripping portions 18, 20 and head portions 22, 24, respectively, connected to or integrally formed with the gripping portions 18, 20. A power supply or power cord 26 is connected the handle end of one of the elongated members 12, 14 to provide electricity to the hair straightening appliance 10. The power cord 26 is configured to engage a suitable electrical outlet (e.g., a wall outlet, etc.). However, in other embodiments, any suitable source of electricity may be incorporated into the hair straightening appliance 10, including, but not limited to a battery or rechargeable battery.

Figure 2:
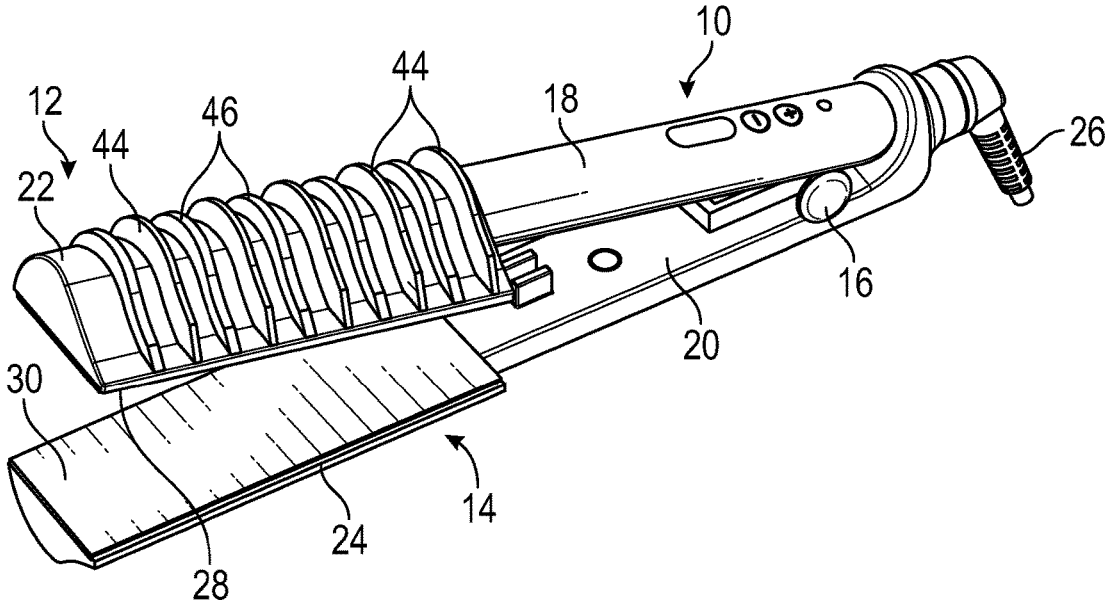
FIG. 2 is a perspective view of the hair straightening and styling appliance of FIG. 1, illustrating an open position.

As best shown in FIG. 2, each of the elongated members 12, 14 includes a heating platen or plate 28, 30 carried on the inner surfaces of the respective head portions 22, 24. In an embodiment, the heating plates 28, 30 are substantially planar. Conventional electric heating elements (not shown) as are known to those skilled in the art provide heat to either or both plates 28, 30. The hair straightening appliance 10 also includes one or more control buttons and dials to control heat settings. For example, in an embodiment, the appliance 10 includes a temperature display 32 and buttons 34, 36 for selectively increasing or decreasing temperature of the plates 28, 30.

In an embodiment, the heating plates 28, 30 may be made of metal or other suitable materials and may be treated or coated with one or more of ceramics, tourmaline, non-metals, metals, and other materials. Ion generators and infrared generators, including far infrared, may be incorporated into the appliance. The appliance may be vented for wet and dry applications, and it may have a steam generator and fluid reservoir to create on-demand steam. A variable steam output feature may be implemented to selectively control amounts or rates of steam emission, as opposed to merely having steam and no steam settings. A fan and heater may be included in the appliance to selectively blow cool or heated air while styling.

As shown in FIGS. 1 and 2, the elongated members 12, 14 are pivotable about the hinge 16 by exerting a squeezing force on one or both the elongated members 12, 14 to clamp strands of hair between the opposed heating plates 28, 30, as discussed hereinafter. The hinge 16 is preferably a spring-loaded hinge 16 that is configured to normally bias the elongated members 12, 14 to the open position shown in FIG. 2. In this respect, the elongated members 12, 14 are moveable (by squeezing), against the spring bias of the hinge 16, to a closed position shown in FIG. 1 to clamp hair between the heating plates 28, 30 to straighten hair.

Figure 6:
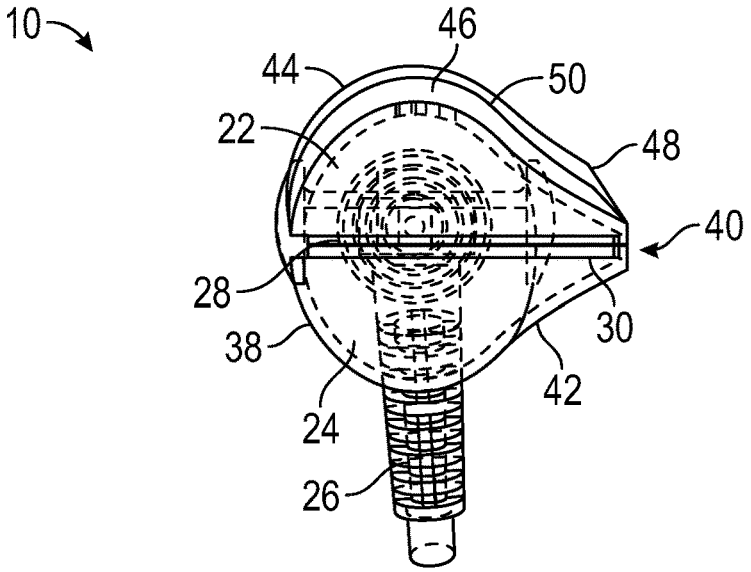
FIG. 6 is an end elevational view of the hair straightening and styling appliance of FIG. 1.

With particular reference to FIGS. 1 and 6, in an embodiment, the head of the appliance 10, in the closed state, is teardrop in cross-section (i.e., when viewed from the distal end). In particular, each head portion 22, 24 is shaped like half of a teardrop in cross section, such that when the head portions 22, 24 are brought into contact with one another by pivoting about hinge 16, a teardrop shape is formed. In particular, as shown in FIG. 6, the exterior surface of each head portion 22, 24 is shaped such that, in the closed state, the head of the appliance 10 has an enlarged or rounded edge 38 (convex in shape) on one side of the appliance 10 that tapers to a fine/narrow edge or point 40 on the opposite side of the appliance 10. In an embodiment, the surface 42 connecting a general tangent point of the rounded edge 38 to the point 40 is concave, as best shown in FIG. 6. In this respect, the exterior surface of each head portion 22, 24 has a rounded edge 38 and opposed tapered edge 40. Importantly, the fine, tapered edge of the appliance 10 provides the ability to reach close to a user's scalp or in tight spaces, such in the case of parted hair, thus enabling a user to straighten hair very close to the scalp and to allow the user to lift the hair from the roots, while the curved edge 38 allows for the curling of hair.

As further shown in FIGS. 1-6, in an embodiment, the hair straightening appliance also includes a plurality of protrusions in the form of ribs or fins 44, 46 on the outer peripheral surface of the head portion 22 of the first elongated member 12. The ribs 44, 46 preferably extend, in the circumferential direction, from the rounded edge 38 of the head portion 22, to the tapered edge 40. In an embodiment, the ribs 44, 46 are spaced equidistant from one another and have the same height and shape. In other embodiments, such as shown in FIGS. 1-6, ribs 44 are taller than ribs 46, and the ribs 44, 46 are arranged in an alternating manner moving in the longitudinal direction.

Figure 3:
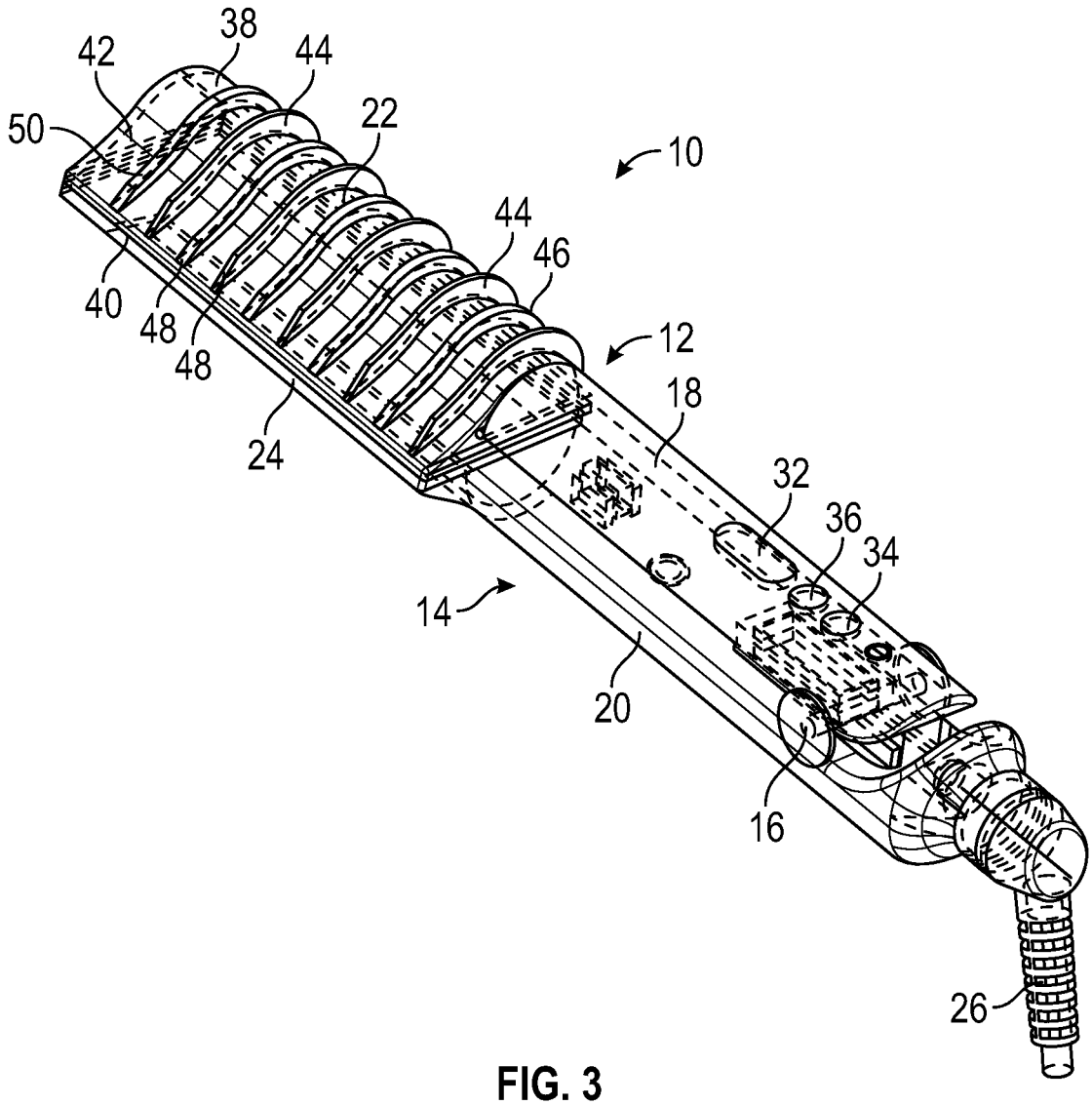
FIG. 3 is a perspective view of the hair straightening and styling appliance of FIG. 1, in the closed position.
Figure 4:
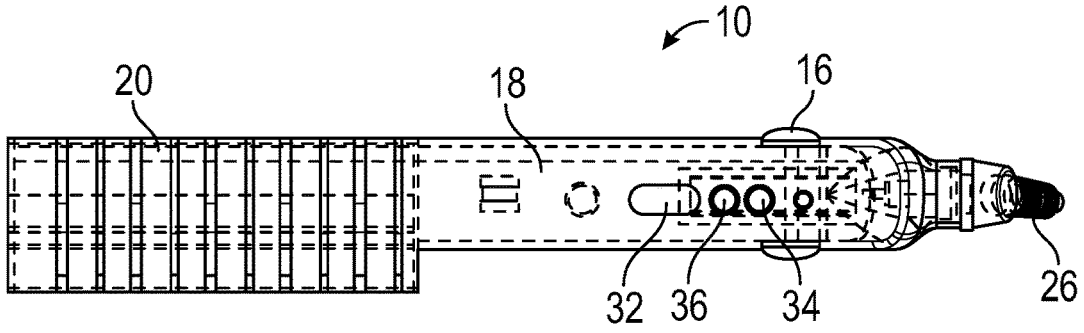
FIG. 4 is top plan view of the hair straightening and styling appliance of FIG. 1
Figure 5:
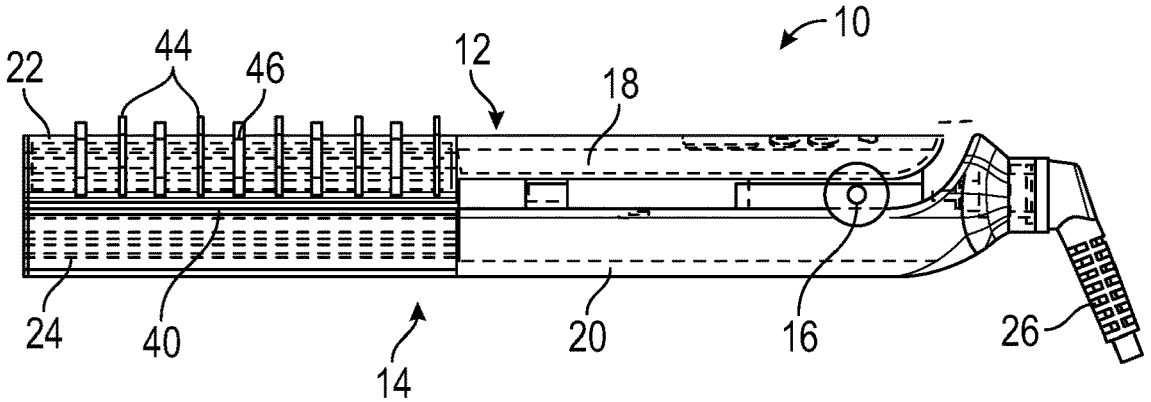
FIG. 5 is a side elevational view of the hair straightening and styling appliance of FIG. 1.

As best illustrated in FIG. 3, one or more of the ribs 44, 46 have a tapered or chamfered end 48 adjacent to the tapered edge 40 of the head portion 22. In other embodiments, the ribs 44, 46 may have a height that decreases progressively moving from the rounded edge 38 and approaching the tapered edge 40. Also shown in FIG. 3, the ribs 44, 46 may each have a convexly curved portion 50 that generally tracks the profile or curvature of the head portion 22.

While FIGS. 1-6 illustrate the ribs on only the first elongated member, in other embodiments, both head portions 22, 24 may have ribs on an outer surface thereof (such that the head portions 22, 24 are mirror images of one another.

In use, a user places hair between the elongated members 12, 14 and squeezes them together to clamp the hair between the opposed heating plates 28, 30. A user than gently pulls the appliance away from the user's head to straighten the hair between the heating plates 28, 30. The curved or rounded edge 38 of the head portions 22, 24 allow the hair to be styled with a curve, wave, or flip after it is straightened. Thus, a user can straighten a portion of the hair and then curl or flip that portion or a different portion using the same device. This saves the user the space and money of having to have two devices for styling the hair, and also saves the time of waiting for a second device to heat up to the proper temperature.

Importantly, as noted above, the fine, tapered edge 40 allows the user to straighten the hair very close to the scalp without burning the skin (and to reach tight spaces like parted hair when straightening near the part line), and also allows the user to lift the hair from the roots in order to create more volume. The rounded edge may then be used to style the ends of the hair when a curl of flip is desired; that is, it facilitates curling when the user twists the appliance 10 while drawing hair out from between the heated plates 28, 30. In addition, the ribs 44, 46 help prevent hair from being rolled up in a deviated manner when styling by serving as separating elements or guides during the styling process (e.g., curl, wave, flip). Accordingly, using the appliance 10, it is possible to smoothly roll up the hair and uniformly curl the hair.

Figure 7:
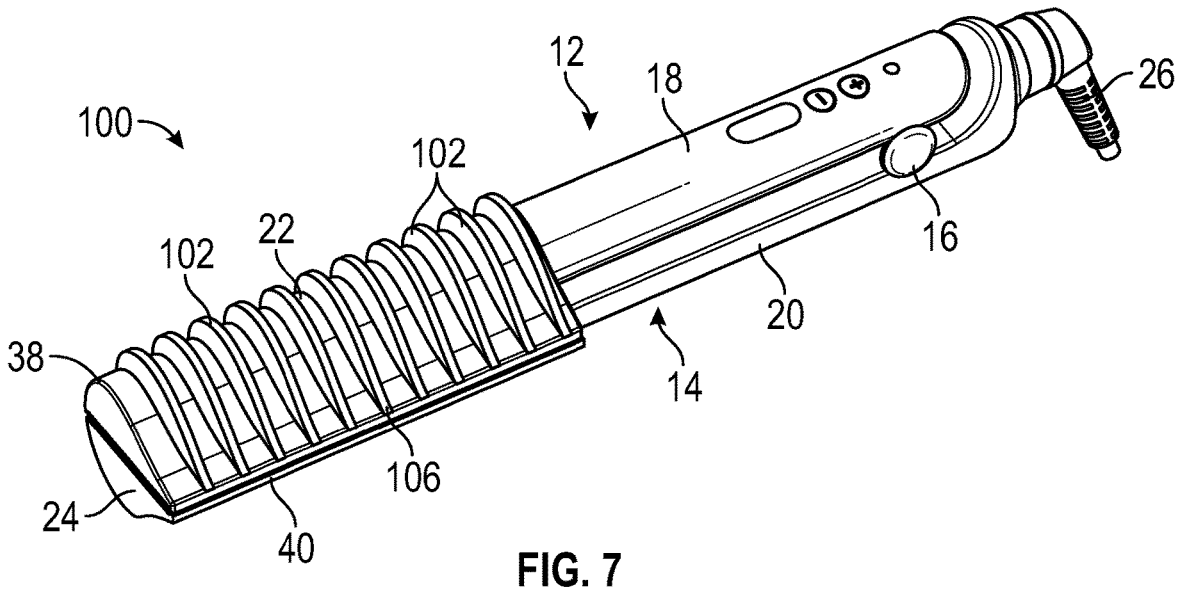
FIG. 7 is a perspective view of a hair straightening and styling appliance according to another embodiment of the present invention, illustrating a closed position.
Figure 8:
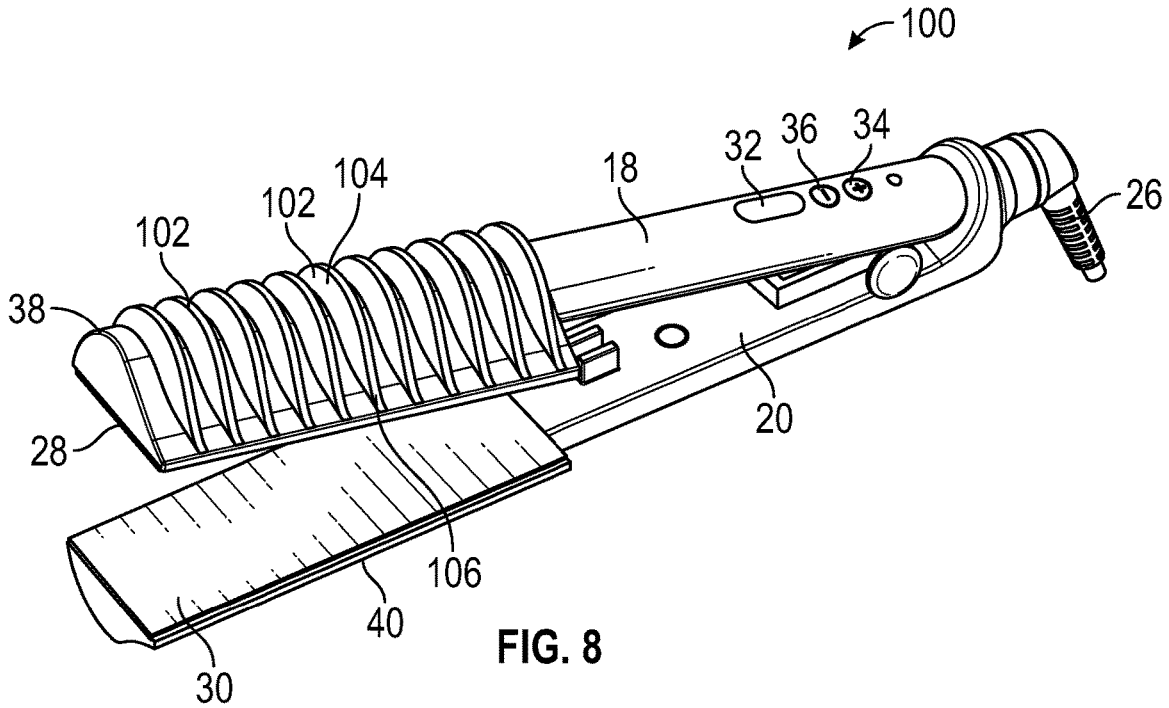
FIG. 8 is a perspective view of the hair straightening and styling appliance of FIG. 7, illustrating an open position.

Turning now to FIGS. 7 and 8, a hair straightening and styling appliance 100 according to another embodiment of the present invention is illustrated. The hair styling appliance 100 is generally similar in configuration and operation to hair styling appliance 10, where like reference numerals designate like parts. In particular, as shown therein, the head portion of the appliance 100 is teardrop-shaped when viewed in cross-section, has a fine or tapered edge 40 allowing for a user to reach close to the scalp of a user and to access tight spaces like part lines, and to engage hair from the roots, and an opposed, rounded edge 38 which allows for easy styling of hair, e.g., curling as the hair is withdrawn from between the heating plates 28, 30.

Similar to the hair straightening appliance 10, the hair straightening appliance 100 also includes a plurality of ribs 102 equidistantly spaced from one another along the exterior surface of at least one of the head portions 22, 24. As shown in FIGS. 7 and 8, the ribs 102 may also be the same shape and have the same height, although it is contemplated that the ribs 102 may also vary in height and shape similar to the embodiment of FIGS. 1-6. Rather than having a chamfered end, however, the ribs generally track the curvature of the head portion to which they are attached. In particular, the ribs have an enlarged, convex section 104 along the rounded edge 38 of the head portion 22, which transitions to a concave section 106 extending to the tapered edge 40.

Figure 9:
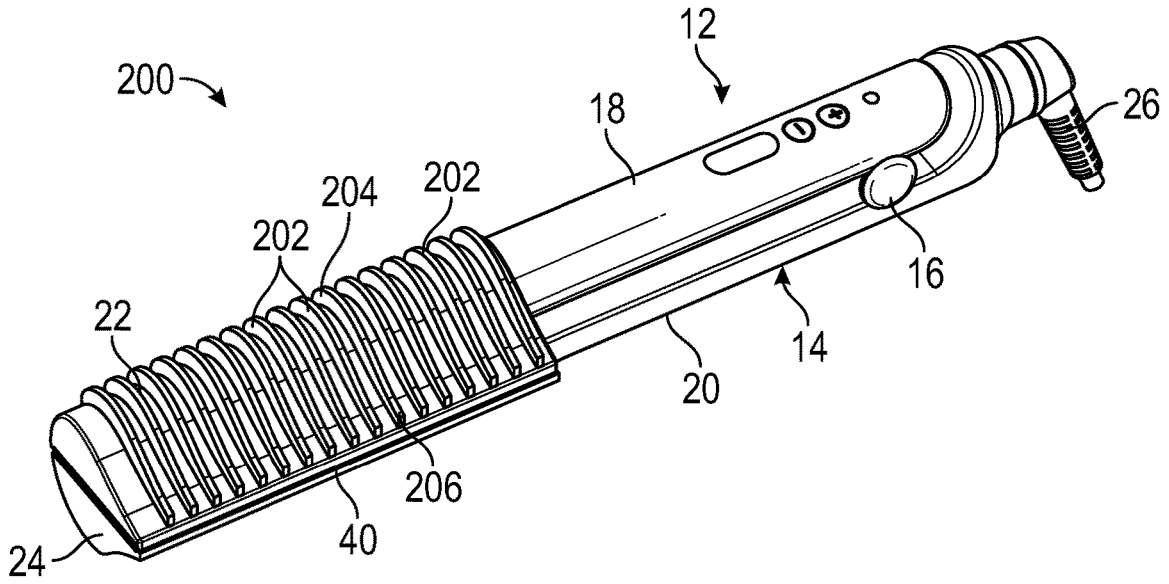
FIG. 9 is a perspective view of a hair straightening and styling appliance according to another embodiment of the present invention, illustrating a closed position.
Figure 10:
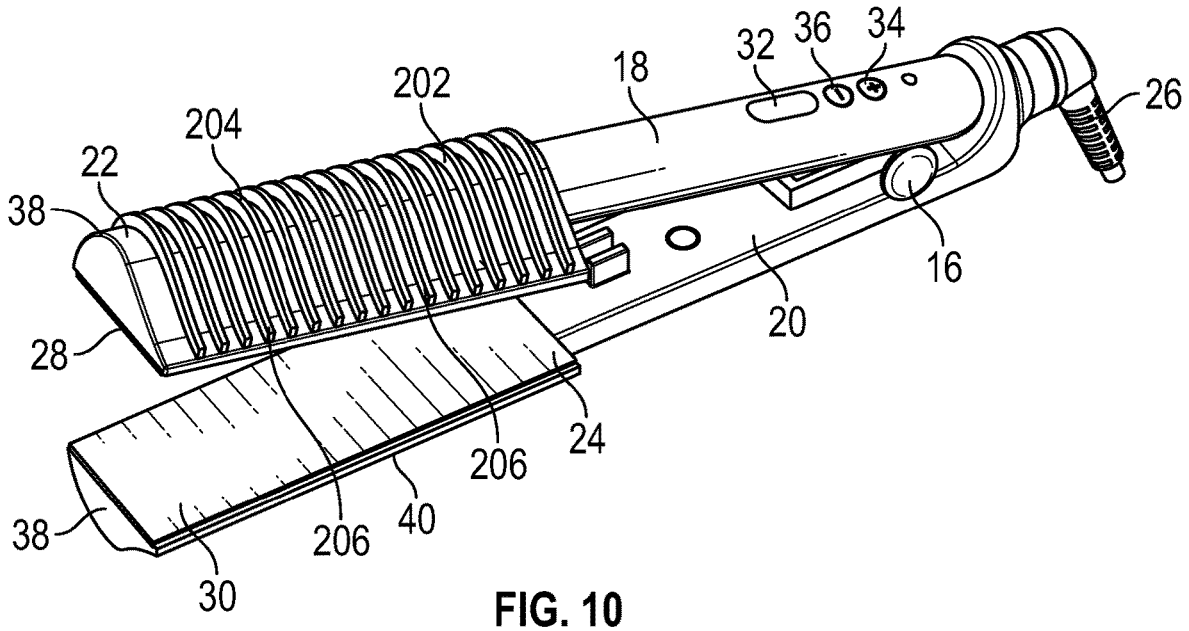
FIG. 10 is a perspective view of the hair straightening and styling appliance of FIG. 9, illustrating an open position.

Turning now to FIGS. 9 and 10, a hair straightening and styling appliance 200 according to another embodiment of the present invention is illustrated. The hair styling appliance 200 is generally similar in configuration and operation to hair styling appliances 10 and 100, where like reference numerals designate like parts. In particular, as shown therein, the head portion of the appliance 200 is teardrop-shaped when viewed in cross-section, has a fine or tapered edge 40 allowing for a user to reach close to the scalp of a user and to access tight spaces like part lines, and to engage hair from the roots, and an opposed, rounded edge 38 which allows for easy styling of hair, e.g., curling as the hair is withdrawn from between the heating plates 28, 30.

Similar to the hair straightening appliance 100, the hair straightening appliance 200 also includes a plurality of ribs 202 equidistantly spaced from one another along the exterior surface of at least one of the head portions 22, 24. As shown in FIGS. 9 and 10, the ribs 202 may also be the same shape and have the same height, although it is contemplated that the ribs 202 may also vary in height and shape similar to the embodiment of FIGS. 1-6. In an embodiment, ribs 202 have an enlarged, convex peripheral section 204 along the rounded edge 38 of the head portion 22, and a peripheral, linear section 206 which extends to the tapered edge 40. In an embodiment, the linear section 206 may transition to a fine point at the tapered edge 40. In another embodiment, the ribs 202 may not taper as they approach the tapered edge 40 (such that there is a vertical edge portion adjacent to the tapered edge 40).

Figure 11:
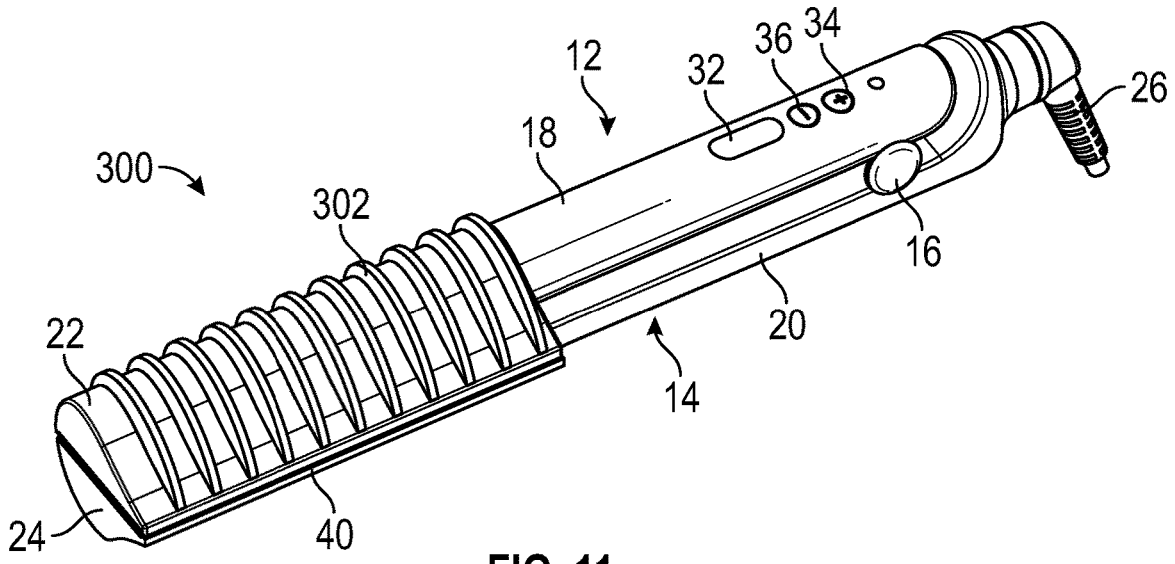
FIG. 11 is a perspective view of a hair straightening and styling appliance according to another embodiment of the present invention, illustrating a closed position.
Figure 12:
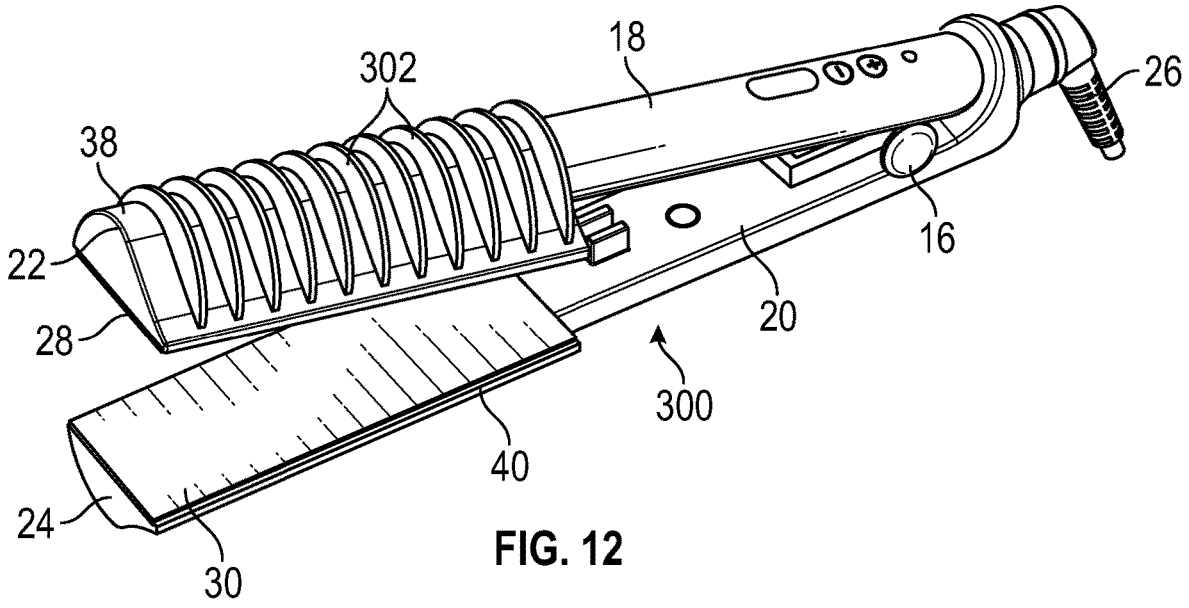
FIG. 12 is a perspective view of the hair straightening and styling appliance of FIG. 11, illustrating an open position.

Referring to FIGS. 11 and 12, a hair straightening and styling appliance 300 according to another embodiment of the present invention is illustrated. The hair styling appliance 300 is generally similar in configuration and operation to hair styling appliance 10, where like reference numerals designate like parts. In particular, as shown therein, the head portion of the appliance 300 is teardrop-shaped when viewed in cross-section, has a fine or tapered edge 40 allowing for a user to reach close to the scalp of a user and to access tight spaces like part lines, and to engage hair from the roots, and an opposed, rounded edge 38 which allows for easy styling of hair, e.g., curling as the hair is withdrawn from between the heating plates 28, 30.

Similar to the hair straightening appliance 10, the hair straightening appliance 300 also includes a plurality of ribs 302 equidistantly spaced from one another along the exterior surface of at least one of the head portions 22, 24. As shown in FIGS. 11 and 12, the ribs 302 may all have the same configuration, although it is contemplated that the ribs 302 may also vary in height and shape similar to the embodiment of FIGS. 1-6. In an embodiment, ribs 302 have a semi-circular peripheral shape of constant radius and extend from the rounded edge 38 of the head portion 22 to the tapered edge 40.

Figure 13:
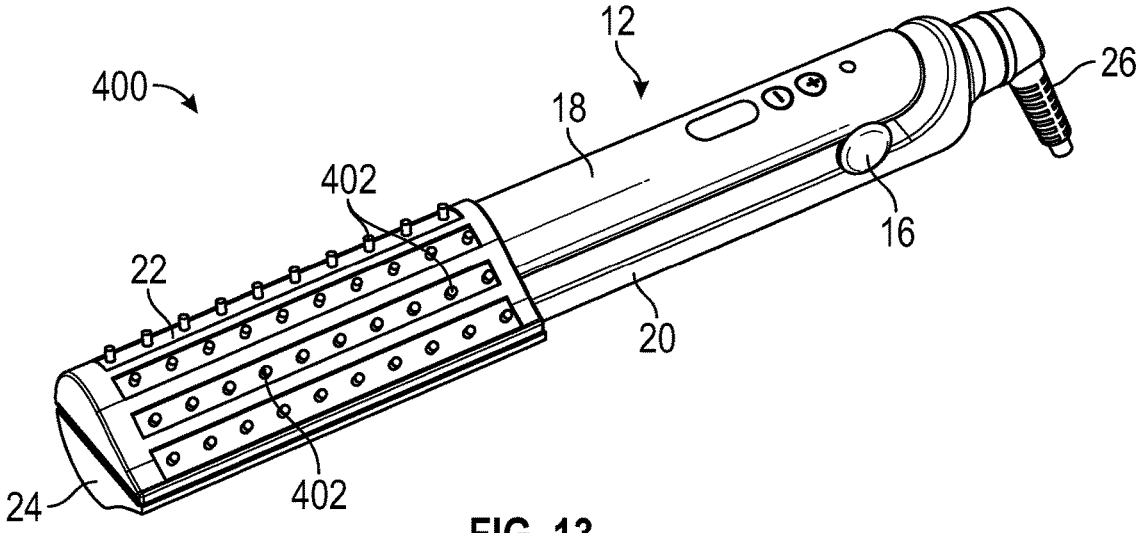
FIG. 13 is a perspective view of a hair straightening and styling appliance according to another embodiment of the present invention, illustrating a closed position.
Figure 14:
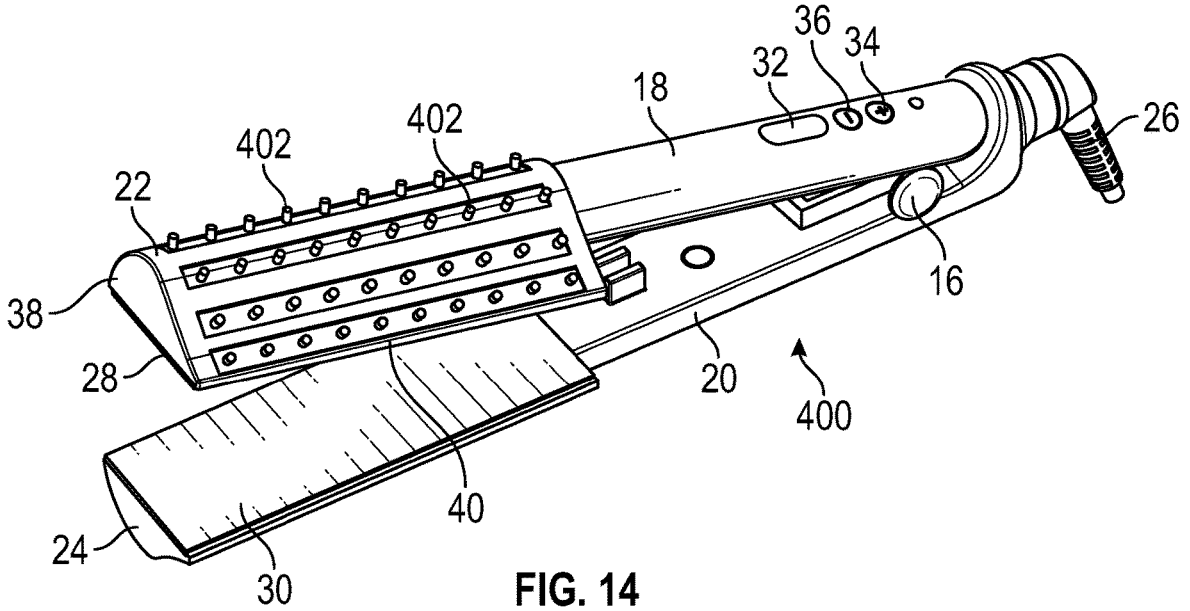
FIG. 14 is a perspective view of the hair straightening and styling appliance of FIG. 13, illustrating an open position.
Figure 15:
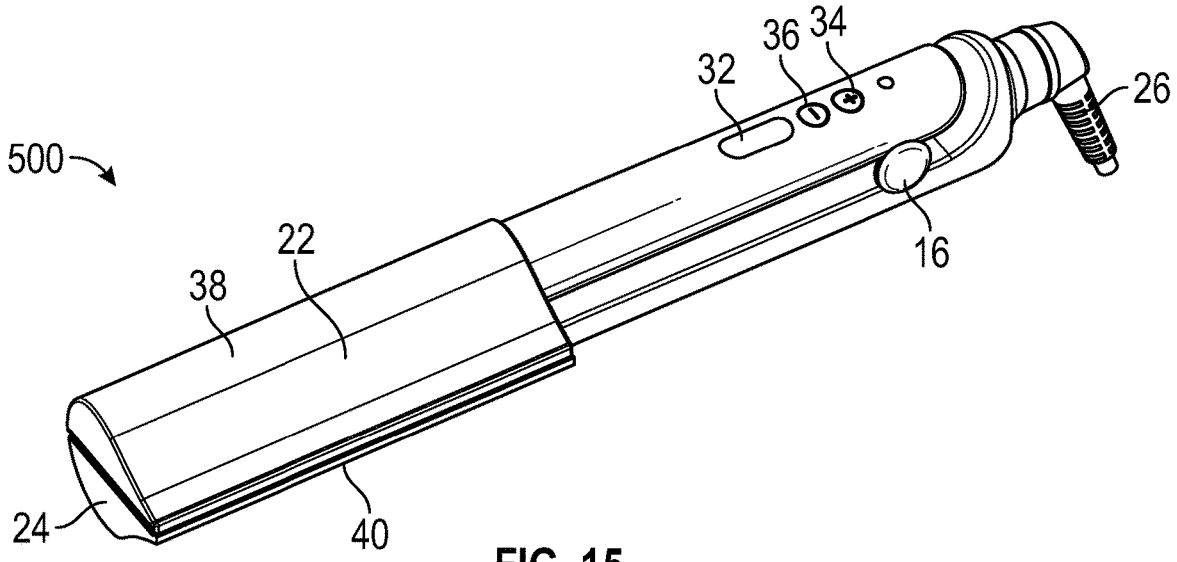
FIG. 15 is a perspective view of a hair straightening and styling appliance according to another embodiment of the present invention, illustrating a closed position.
Figure 16:
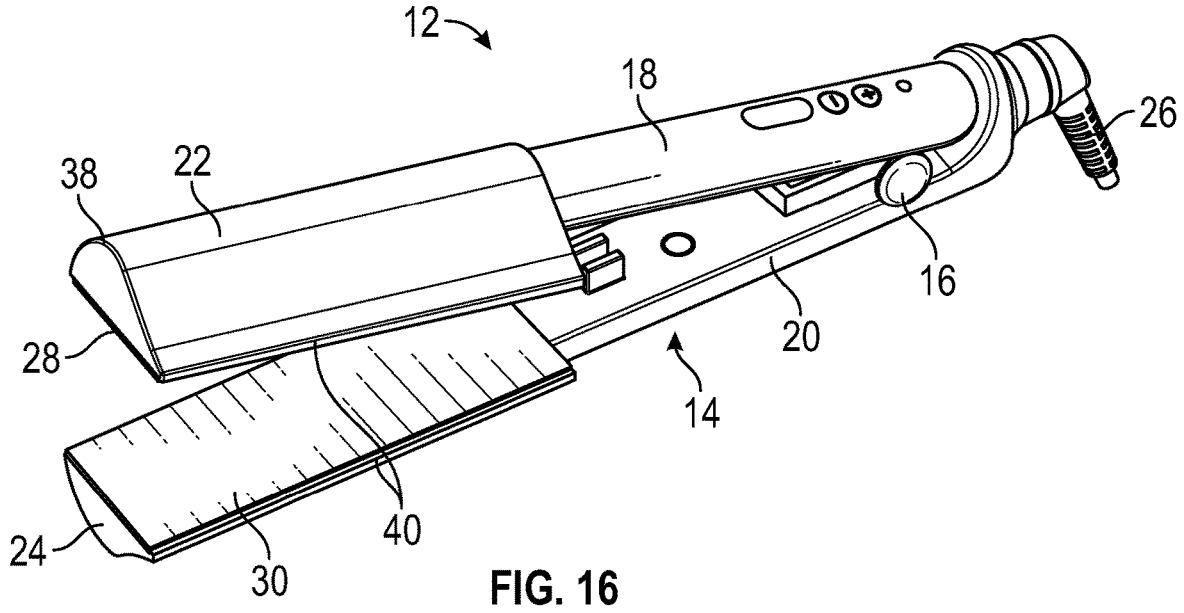
FIG. 16 is a perspective view of the hair straightening and styling appliance of FIG. 15, illustrating an open position.

FIGS. 13 and 14 show a hair straightening and styling appliance 400 according to yet another embodiment of the present invention. The hair styling appliance 400 is generally similar in configuration and operation to hair styling appliance 10, where like reference numerals designate like parts. In particular, as shown therein, the head portion of the appliance 400 is teardrop-shaped when viewed in cross-section, has a fine or tapered edge 40 allowing for a user to reach close to the scalp of a user and to access tight spaces like part lines, and to engage hair from the roots, and an opposed, rounded edge 38 which allows for easy styling of hair, e.g., curling as the hair is withdrawn from between the heating plates 28, 30.

The hair straightening appliance 400 also include a plurality of pins or projections 402 on an exterior surface of at least one of the head portions 22, 24. In an embodiment, the projections 402 are only on the exterior surface of the head portion 22 of the first elongated member 12. As shown in FIGS. 13 and 14, the projections 402 may be arranged in linear, parallel rows, however, it is contemplated that the projections 402 may also be arranged in non-linear and parallel rows, or in a random array. Similar to the ribs, the projections 402 are configured to interact with the hair to separate strands during a styling operation (e.g., curling). In an embodiment, the projections 402 all have the same height. In other embodiments, the projections 402 may have different heights.

It is further contemplated that in an embodiment, a hair straightening and styling appliance may have a combination of ribs and projections on either or both of the head portions of the elongated members.

Figure 17:
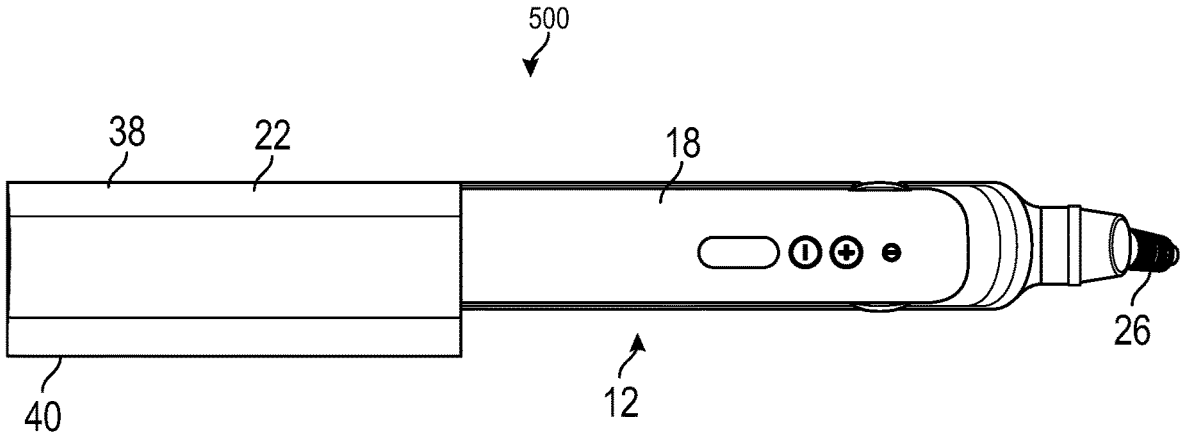
FIG. 17 is a top plan view of the hair straightening and styling appliance of FIG. 15.

Turning finally to FIGS. 17 and 18, a hair straightening and styling appliance 500 according to another embodiment of the present invention is illustrated. The hair styling appliance 500 is generally similar in configuration and operation to hair styling appliance 10, where like reference numerals designate like parts. In particular, as shown therein, the head portion of the appliance 500 is teardrop-shaped when viewed in cross-section, has a fine or tapered edge 40 allowing for a user to reach close to the scalp of a user and to access tight spaces like part lines, and to engage hair from the roots, and an opposed, rounded edge 38 which allows for easy styling of hair, e.g., curling as the hair is withdrawn from between the heating plates 28, 30. Notably, however, the head portions 22, 24 have smooth exterior surfaces, being devoid of any ribs, ribs, projections or the like.

The embodiments of the invention disclosed herein provide various hair straightening and styling appliances that provide an ease of use and performance heretofore not seen in the art. In particular, as indicated above, the tapered, teardrop shaped head of the appliance allows a user to grasp hair close to the scalp and in tight areas like around the part line, while the opposite, rounded edge allows for easily styling immediately after, or simultaneous with, straightening. In addition, the presence of the ribs or projections, facilitate styling and help prevent hair from being rolled up in a deviated manner when styling.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A hair straightening and styling appliance, comprising:

a first elongated member having a first heating plate defining an interior surface of the first elongated member; and a second elongated member having a second heating plate defining an interior surface of the second elongated member, the second heating plate facing the first heating plate, the second elongated member being hingedly connected to the first elongated member allowing for the first heating plate and the second heating plate to be opened and closed away from and toward each other, respectively;

wherein the hair straightening and styling appliance has a teardrop cross-section when the first heating plate and the second heating plates are closed towards each other; and wherein each elongated member includes an exterior surface opposite the first heating plate and the second heating plate, respectively;

wherein the exterior surface of each elongated member opposite the respective first heating plate and the second heating plate has a convex section and a concave section adjacent to the convex section and terminates in a tapered edge;

wherein the first heating plate and the second heating plate are each configured as flat rectangular plates configured to mate with one another to form a flat hair contact surface when in a closed configuration;

wherein the first elongated member and the second elongated member define symmetrical halves of the teardrop shape cross-section of the hair straightening and styling appliance.

2. A hair straightening and styling appliance, comprising:

a first elongated member having a first handle portion and a first head portion, and a first heating plate carried by the first head portion; and a second elongated member having a first handle portion and a second head portion, and a second heating plate carried by the second head portion, the second heating plate facing the first heating plate, the second elongated member being pivotally connected to the first elongated member allowing for the first heating plate and the second heating plate to be opened and closed away from and toward each other, respectively;

wherein the hair straightening and styling appliance has a teardrop cross-section when the first heating plate and the second heating plates are closed towards each other; and wherein the first elongated member and the second elongated member each have an exterior surface opposite the first heating plate and the second heating plate, respectively, that includes a convex section and a concave section adjacent to the convex section and terminates in a tapered edge;

wherein the hair straightening and styling appliance further includes at least one of a plurality of pins and/or a plurality of ribs on an exterior surface of the first head portion and/or the second head portion;

wherein the first heating plate and the second heating plate are each configured as flat metal members configured to mate with one another to form a flat hair contact surface when in a closed configuration; and wherein the flat metal members are configured as rectangular plates and extend over an entire longitudinal extent of the first head portion and the second head portion, respectively, and define continuous flat surfaces.

3. A hair straightening and styling appliance, comprising:

a first elongated member having an interior surface and an exterior surface; and a second elongated member having an interior surface and an exterior surface, the interior surface of the first elongated member and the interior surface of the second elongated member facing one another and defining a gap for receiving hair of a user therebetween;

wherein the second elongated member is hingedly connected to the first elongated member allowing for the first elongated member and the second elongated member to be opened and closed away from and toward each other, respectively;

wherein each of the first elongated member and the second elongated member includes an exterior surface opposite the respective interior surface, the exterior surface of each of the first elongated member and the second elongated member having a convex section and a concave section adjacent to the convex section and terminating in a tapered edge;

wherein at least a portion of the first elongated member is symmetrical with at least a portion of the second elongated member.

4. The hair straightening and styling appliance of claim 1, wherein:

each elongated member includes a handle portion and a head portion;

wherein the first heating plate is arranged on the head portion of the first elongated member; and wherein the second heating plate is arranged on the head portion of the second elongated member.

5. The hair straightening and styling appliance of claim 4, further comprising:

at least one of a plurality of pins and/or a plurality of ribs on the exterior surface of at least one of the first elongated member and the second elongated member.

6. The hair straightening and styling appliance of claim 4, further comprising:

a plurality of ribs on an exterior surface of the head portion of the first elongated member.

7. The hair straightening and styling appliance of claim 6, wherein:

the plurality of ribs include at least a first rib extending a first height from the exterior surface of the head portion of the first elongated member, and at least a second rib extending a second height from the exterior surface of the head portion of the first elongated member;

wherein the first height is different from the second height.

8. The hair straightening and styling appliance of claim 6, wherein:

the plurality of ribs each include a convex section and a concave section adjacent to the convex section and terminating in a tapered edge such that a peripheral curvature of the plurality of ribs corresponds to a peripheral curvature of the head portion of the first elongated member.

9. The hair straightening and styling appliance of claim 8, wherein:

the peripheral curvature forms a half teardrop shape.

10. The hair straightening and styling appliance of claim 8, wherein:

the plurality of ribs each have a tapered end adjacent to the tapered edge of the first elongated member.

11. The hair straightening and styling appliance of claim 6, wherein:

at least one of the ribs has a periphery including a curved section and a linear section.

12. The hair straightening and styling appliance of claim 6, wherein:

the plurality of ribs are semi-circular in shape and have a constant radius.

13. The hair straightening and styling appliance of claim 4, further comprising:

a plurality of projections on an exterior surface of the head portion of the first elongated member.

14. The hair straightening and styling appliance of claim 13, wherein:

the plurality of projections are arranged in a plurality of linear rows.

15. The hair straightening and styling appliance of claim 14, wherein:

the plurality of projections have different heights.

16. The hair straightening and styling appliance of claim 2, wherein:

the hair straightening and styling appliance includes the plurality of ribs on the exterior surface of the first head portion of the first elongated member;

wherein the plurality of ribs include at least a first rib extending a first height from the exterior surface of the head portion of the first elongated member, and at least a second rib extending a second height from the exterior surface of the head portion of the first elongated member;

wherein the first height is different from the second height.

17. The hair straightening and styling appliance of claim 2, wherein:

the hair straightening and styling appliance includes the plurality of ribs on the exterior surface of the first head portion of the first elongated member;

wherein each of the plurality of ribs has a periphery that forms one of a half teardrop shape and a semi-circular shape.

18. The hair straightening and styling appliance of claim 2, wherein:

the hair straightening and styling appliance includes the plurality of ribs and the plurality of projections on the exterior surface of the first head portion of the first elongated member.

19. The hair straightening and styling appliance of claim 3, further comprising:

a plurality of pins on the exterior surface of at least one of the first elongated member and the second elongated member, the plurality of pins being arranged in parallel rows.

* * * * *